United States Patent [19]

Nishimoto

[11] 4,375,777

[45] Mar. 8, 1983

[54] ELECTRONIC MUSICAL INSTRUMENT

[75] Inventor: Tetsuo Nishimoto, Hamamatsu, Japan

[73] Assignee: Nippon Gakki Seizo Kabushiki Kaisha, Tokyo, Japan

[21] Appl. No.: 313,334

[22] Filed: Oct. 20, 1981

Related U.S. Application Data

[63] Continuation of Ser. No. 91,341, Nov. 5, 1979, abandoned.

[30] Foreign Application Priority Data

Nov. 11, 1978 [JP] Japan ..... 53-139184

[51] Int. Cl.[3] ..... G10H 1/08; G10H 1/12; G10H 7/00

[52] U.S. Cl. ..... 84/1.19; 84/1.21; 84/1.23; 84/1.24; 364/721

[58] Field of Search ..... 84/1.01, 1.11, 1.12, 84/1.19, 1.21–1.24; 364/721

[56] References Cited

U.S. PATENT DOCUMENTS

| | | | |
|---|---|---|---|
| 3,740,450 | 6/1973 | Deutsch | 84/1.24 |
| 3,809,786 | 5/1974 | Deutsch | 84/1.01 |
| 3,992,973 | 11/1976 | Howell | 84/1.23 |
| 4,077,294 | 3/1978 | Hiyoshi et al. | 84/1.23 |
| 4,131,049 | 12/1978 | Okumura et al. | 84/1.01 |
| 4,135,422 | 1/1979 | Chibana | 84/1.01 |

*Primary Examiner*—Stanley J. Witkowski

*Attorney, Agent, or Firm*—Thompson, Birch, Gauthier & Samuels

[57] ABSTRACT

A buzz wave comprising n harmonic components having a flat spectrum envelope is generated according to a relatively simple algebraic expression which can be digitally computed by an arithmetic operation. Modifying harmonic components corresponding to the harmonic components to be emphasized or suppressed are also generated. The buzz wave and the modifying components are added or subtracted to form a desired musical tone signal.

17 Claims, 14 Drawing Figures

ELECTRONIC MUSICAL INSTRUMENT

This application is a continuation of application Ser. No. 91,341, filed Nov. 5, 1979, and now abandoned.

BACKGROUND OF THE INVENTION

This invention relates to an electronic musical instrument of the digital type.

A harmonic synthesis type electronic musical instrument disclosed in U.S. Pat. No. 3,809,786 issued on May 4, 1974 shows a typical digital electronic musical instrument. This harmonic synthesis type electronic musical instrument is constructed to calculate respective harmonic components which constitute a musical tone, to multiply calculated harmonic components with corresponding amplitude coefficients, and then to synthesize the products to form a musical tone. However, when it is desired to synthesize a musical tone containing a great number of harmonic components, it is necessary to increase the number of the calculating time slots.

An improved electronic musical instrument capable of producing a musical tone containing many harmonic components without increasing the calculation speed is disclosed in U.S. Pat. No. 4,135,422 dated Jan. 23, 1979.

According to this patent, a musical tone is formed by operating the following equations:

$$F(x,y) = \sum_{k=1}^{n} \sin\{x + (k-1)\cdot y\} = \frac{\sin\{f(x) + \frac{n-1}{2}\cdot f(y)\}\cdot \sin\frac{n}{2}\cdot f(y)}{\sin\frac{f(y)}{2}} \quad (1)$$

$$F(x,y) = \sum_{k=1}^{n} \cos\{x + (k-1)\cdot y\} = \frac{\cos\{f(x) + \frac{n-1}{2}\cdot f(y)\}\sin\frac{n}{2}\cdot f(y)}{\sin\frac{f(y)}{2}} \quad (2)$$

where f(x) and f(y) represent functions containing time variables, and n any interger. If f(x) and f(y) in equations (1) and (2) are made to be $f(x)=f(y)=\omega t$ (angular frequency information) a buzz wave having a spectral envelope or distribution in which the amplitudes of the harmonic components are flat as shown by the waveform shown in FIG. 1A. When a coefficient term sin $\{\alpha+(k-1)\beta\}$ is added to equation (1) and calculated according to the following equation (3) it is possible to produce a musical tone signal having a frequency characteristic as if the signal were passed through a filter, as shown by FIG. 1B.

$$F(x,y) = \sum_{k=1}^{n} \sin\{\alpha + (k-1)\beta\}\cdot\sin\{x + (k-1)y\} \quad (3)$$

As can be noted from equation (3), according to the electronic musical instrument disclosed in this U.S. Pat. the coefficient term necessary to produce a desired musical tone is given as a certain type of a frequency function.

SUMMARY OF THE INVENTION

Accordingly, it is an object of this invention to provide an improved electronic musical instrument capable of producing musical tones which are complicated in harmonic contents so that the instrument can simulate musical tones of natural musical instruments with simple construction.

Another object of the invention is to provide an electronic musical instrument in which musical tones are controlled in amplitude of desired harmonic components of certain orders.

According to this invention, a buzz wave comprising n harmonic components of different orders having a flat spectral envelope is generated according to equations (1) or (2). Modifying harmonic components (merely termed as modifying components) corresponding to the harmonic components to be emphasized or suppressed are also generated and the buzz wave and the modifying components are added or subtracted to form a desired musical tone signal.

Briefly stated, the electronic musical instrument comprises a function generator for producing a function f(x) containing a time variable corresponding to the tone pitch of a depressed key of a keyboard of the electronic musical instrument; an arithmetic operator for digitally calculating an expression $$\frac{\sin\frac{n\cdot f(x)}{2}\cdot\sin\frac{(n+1)\cdot f(x)}{2}}{\sin\frac{f(x)}{2}} \pm \sum_{i=1}^{m} \sin Hi\cdot f(x) \text{ or}$$

$$\frac{\sin\frac{n\cdot f(x)}{2}\cdot\sin\frac{(n+1)\cdot f(x)}{2}}{\sin\frac{f(x)}{2}} \pm \sum_{i=1}^{m} \cos Hi\cdot f(x)$$

where n represents the number of harmonic components constituting a buzz wave, Hi is the order of each harmonic component to be modified, m is the number of the harmonic components to be modified and satisfies the condition $1 \leqq m < n$; and a digital-analogue converter for converting the output of the arithmetic operator into a corresponding analogue musical signal.

Depending upon the tone color or variety of the musical tone signal to be produced, the expressions to be digitally calculated may be changed in the following manner:

$$\frac{\sin\frac{n\cdot f(x)}{2}\cdot\cos\frac{(n+1)\cdot f(x)}{2}}{\sin\frac{f(x)}{2}} \pm \sum_{i=1}^{m} \sin Hi\cdot f(x) \text{ or}$$

$$\frac{\sin\frac{n\cdot f(x)}{2}\cdot\cos\frac{(n+1)\cdot f(x)}{2}}{\sin\frac{f(x)}{2}} \pm \sum_{i=1}^{m} \cos Hi\cdot f(x) \text{ or}$$

$$\frac{\sin^2\{n\cdot f(x)\}}{\sin f(x)} \pm \sum_{i=1}^{m} \sin Hi\cdot f(x) \text{ or}$$

$$\frac{\sin^2\{n\cdot f(x)\}}{\sin f(x)} \pm \sum_{i=1}^{m} \cos Hi\cdot f(x) \text{ or}$$

$$\frac{\cos\{n\cdot f(x)\}\cdot\sin\{n\cdot f(x)\}}{\sin f(x)} \pm \sum_{i=1}^{m} \sin Hi\cdot f(x) \text{ or}$$

$$\frac{\cos\{n\cdot f(x)\}\cdot\sin\{n\cdot f(x)\}}{\sin f(x)} \pm \sum_{i=1}^{m} \cos Hi\cdot f(x) \text{ or}$$

$$\frac{\sin\{n\cdot f(x)\}\cdot\sin\{(n+1)\cdot f(x)\}}{\sin f(x)} \pm \sum_{i=1}^{m} \sin Hi\cdot f(x) \text{ or}$$

-continued $$\frac{\sin\{n\cdot f(x)\}\cdot\sin\{(n+1)\cdot f(x)\}}{\sin f(x)} \pm \sum_{i=1}^{m}\cos Hi\cdot f(x) \text{ or}$$

$$\frac{\sin\{n\cdot f(x)\}\cdot\cos\{(n+1)\cdot f(x)\}}{\sin f(x)} \pm \sum_{i=1}^{m}\sin Hi\cdot f(x) \text{ or}$$

$$\frac{\sin\{n\cdot f(x)\}\cdot\cos\{(n+1)\cdot f(x)\}}{\sin f(x)} \pm \sum_{i=1}^{m}\cos Hi\cdot f(x)$$

DESCRIPTION OF THE PREFERRED EMBODIMENT

Figure 1A:
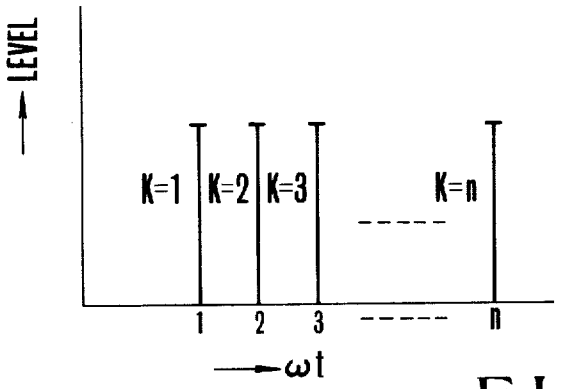
FIG. 1A PRIOR ART
FIGS. 1A and 1B are graphs useful to explain a prior art method of generating a musical tone.
Figure 1B:
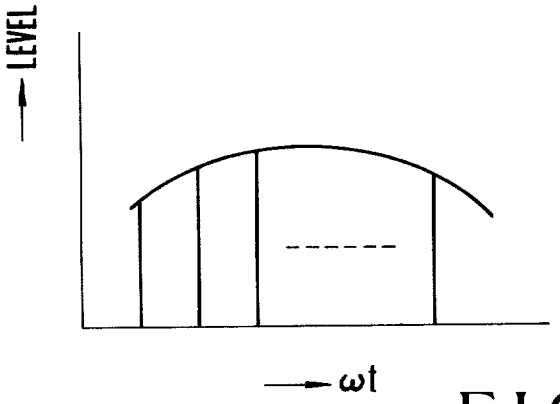
FIG. 1B PRIOR ART

The principle of this invention will firstly be described. At first, a buzz wave having n harmonic components is formed as f(x)=f(y) in equations (1) and (2).

Putting now x=y, and f(x)=f(y) in equations (1) and (2), equation (1) becomes $$F(x) = \sum_{k=1}^{n}\sin kx \tag{4}$$

$$= \frac{\sin\frac{n\cdot f(x)}{2}\cdot\sin\frac{(n+1)\cdot f(x)}{2}}{\sin\frac{f(x)}{2}}$$

and equation (2) becomes $$F(x) = \sum_{k=1}^{n}\cos kx \tag{5}$$

-continued $$= \frac{\sin\frac{n\cdot f(x)}{2}\cdot\cos\frac{(n+1)\cdot f(x)}{2}}{\sin\frac{f(x)}{2}}$$

Thus, a buzz wave comprising n harmonic components in a harmony is formed.

Next, a harmonic component sin Hi·f(x) or cos Hi·f(x) at any order to be modified (emphasized or suppressed) is added to or subtracted from the buzz wave so as to generate a musical tone signal according to the result of the arithmetical operation. The musical tone signals thus produced are expressed by the following equations (6) to (9).

$$\text{(a)}\quad \frac{\sin\frac{n\cdot f(x)}{2}\cdot\sin\frac{(n+1)\cdot f(x)}{2}}{\sin\frac{f(x)}{2}} \pm \sum_{i=1}^{m}\sin Hi\cdot f(x) \tag{6}$$

$$\text{(b)}\quad \frac{\sin\frac{n\cdot f(x)}{2}\cdot\sin\frac{(n+1)\cdot f(x)}{2}}{\sin\frac{f(x)}{2}} \pm \sum_{i=1}^{m}\cos Hi\cdot f(x) \tag{7}$$

$$\text{(c)}\quad \frac{\sin\frac{n\cdot f(x)}{2}\cdot\cos\frac{(n+1)\cdot f(x)}{2}}{\sin\frac{f(x)}{2}} \pm \sum_{i=1}^{m}\sin Hi\cdot f(x) \tag{8}$$

$$\text{(d)}\quad \frac{\sin\frac{n\cdot f(x)}{2}\cdot\cos\frac{(n+1)\cdot f(x)}{2}}{\sin\frac{f(x)}{2}} \pm \sum_{i=1}^{m}\cos Hi\cdot f(x) \tag{9}$$

The buzz waves generated by equations (4) and (5) contain all even and odd order harmonic components. As shown in the following equations (10) and (11), a buzz wave comprising only odd order harmonic components may be produced by making K=2k−1. A buzz wave comprising only even order harmonic components can be produced, as shown by the following equations (12) and (13), where k represents any integer.

$$\sum_{k=1}^{n}\sin(2k-1)\cdot x = \frac{\sin^2\{n\cdot f(x)\}}{\sin f(x)} \tag{10}$$

$$\sum_{k=1}^{n}\cos(2k-1)\cdot x = \frac{\cos\{n\cdot f(x)\}\cdot\sin\{n\cdot f(x)\}}{\sin f(x)} \tag{11}$$

$$\sum_{k=1}^{n}\sin k\cdot 2x = \frac{\sin\{n\cdot f(x)\}\cdot\sin\{(n+1)\cdot f(x)\}}{\sin f(x)} \tag{12}$$

$$\sum_{k=1}^{n}\cos k\cdot 2x = \frac{\sin\{n\cdot f(x)\}\cdot\cos\{(n+1)\cdot f(x)\}}{\sin f(x)} \tag{13}$$

In equations (4) to (13) the function f(x) is usually set as an angular frequency information ωt corresponding to the tone pitch of a depressed key. As above described, according to the principle of this invention, it is only necessary to add or subtract a harmonic component or components of a desired order or orders to and from a buzz wave comprising n harmonic components so that, even when the number of the harmonic components constituting a musical tone signal is large, it is possible to effect high speed arithmetic operation to produce a variety of musical tones.

Figure 2:
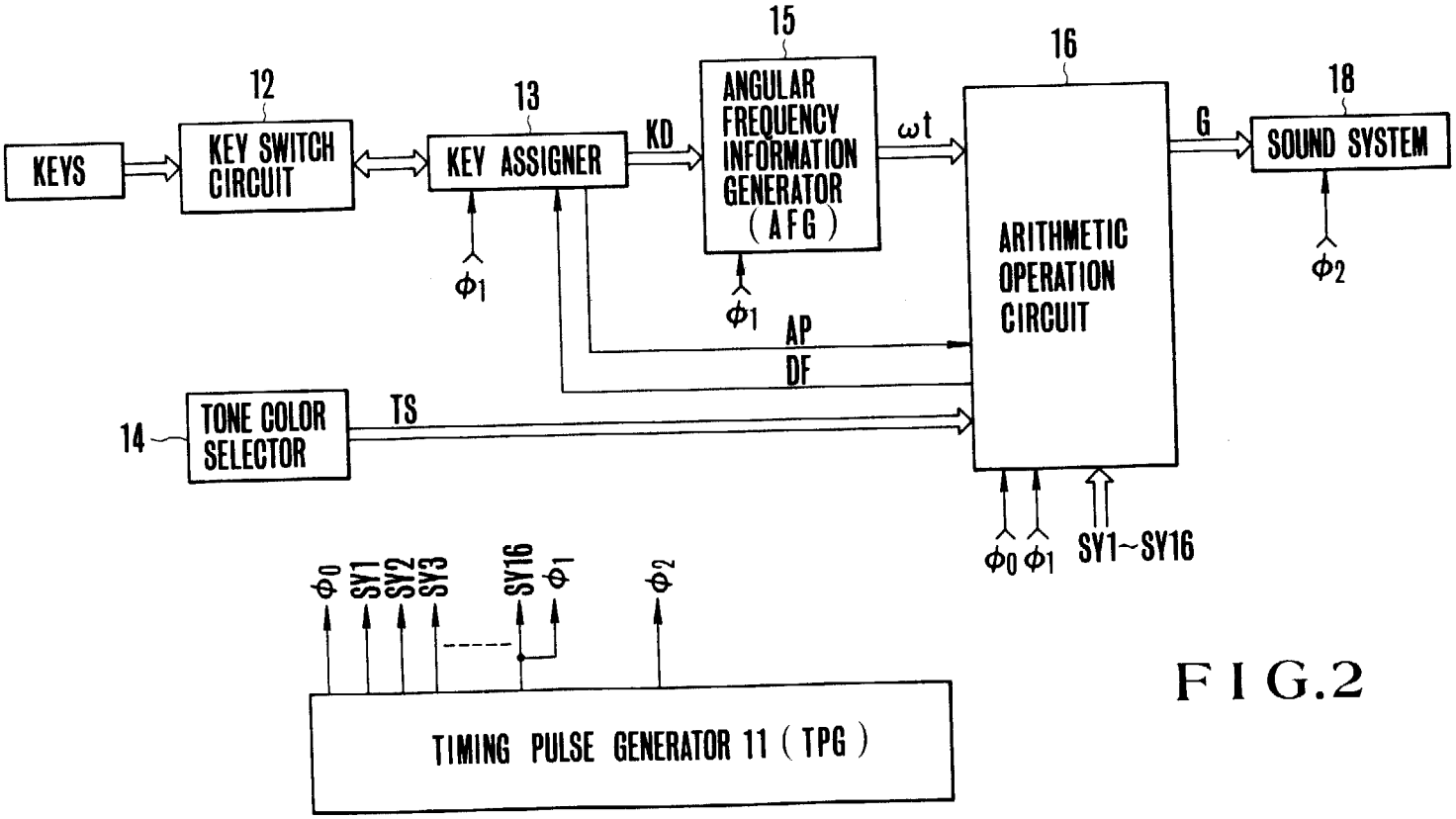
FIG. 2 is a block diagram showing one embodiment of the electronic musical instrument according to this invention.

A preferred embodiment of this invention will now be described. An electronic musical instrument embodying the invention and shown in FIG. 2 is a polyphonic electronic musical instrument comprising 16 tone generating channels for simultaneously generating 16 types of musical tones. The musical tone signal formed in each tone generating channel is formed according to the following equation (14) which is obtained by adding to equation (7) an amplitude coefficient A0 of a buzz wave and an amplitude coefficient Ai of the modifying component of each order.

$$0 \cdot \frac{\sin\frac{n \cdot \omega t}{2} \cdot \sin\frac{(n+1) \cdot \omega t}{2}}{\sin\frac{\omega t}{2}} - \sum_{i=1}^{m} i \cdot \sin(Hi \cdot \omega t) \quad (14)$$

The electronic musical instrument shown in FIG. 2 comprises a timing pulse generator (TPG) 11 which produces a timing pulse $\phi 0$ for sequentially forming musical tone signals of 16 tone generating channels, arithmetic operation state signal SY1 to SY16 (Ø1), and a channel synchronizing signal $\phi 2$; a key switch circuit 12 having key switches corresponding to respective keys of a keyboard; a key assigner 13 which detects the ON or OFF operation of a key switch corresponding to a depressed key of the keyboard for assigning the musical tone designated by a depressed key to either one of 16 tone generating channels; a tone color selector 14 for selecting the tone color of the generated musical tone; an angular frequency information generator (AFG) 15 which produces an angular frequency information $\omega t$ corresponding to the tone pitch of a depressed key assigned to a tone generating channel on a time division basis and in synchronism with a given channel time; an arithmetic operation circuit 16 which digitally calculates and generates a musical tone signal of each tone generating channel corresponding to equation (14); and a sound system 18 which synthesizes musical tone signals G of respective tone generating channels and then converts the synthesized signals into analogue musical signals which are produced as musical tones.

Figure 3:
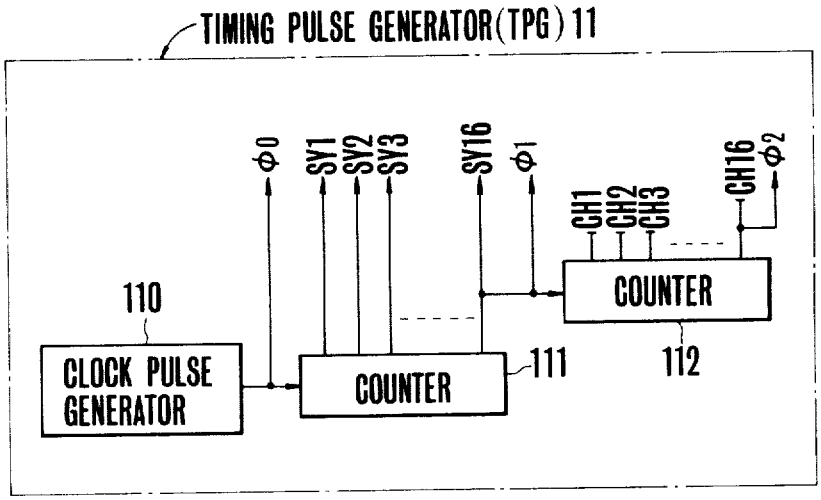
FIG. 3 is a block diagram showing one example of a timing pulse generator utilized in the electronic musical instrument shown in FIG. 2.

As shown in FIG. 3, the timing pulse generator 11 comprises a clock pulse generator 110 which produces a clock pulse Ø0 having a predetermined period $\tau 0$ corresponding to one calculation time (arithmetic operation state) ST; a counter 111 which counts the number of the clock pulses Ø0 for producing arithmetic operation state signals SY1 to SY16 (Ø1); and a counter 112 which counts the number of the arithmetic operation state signal SY16 (Ø1) to produce channel signals CH1 to CH16 (Ø2) representing respective channel times CHT of the 16 tone generating channels. The arithmetic operation state signal SY16 produced by the counter 111 is supplied to the key assigner 13, the AFG 15, and the arithmetic operation circuit 16 as an arithmetic operation cycle signal Ø1 showing that one cycle of the arithmetic operation has been completed for each tone generating channel. The channel signal CH16 generated by the counter 112 is applied to the sound system 18 as a channel synchronizing signal showing that one cycle of operation of all tone generating channels has been completed. The time relationship between the arithmetic operation state ST and the channel time CHT are shown graphically in FIG. 4. As shown, the arithmetic operation state ST has a period 1/16 of that of the channel time CHT and varies in 16 manners of ST1 to ST16 in each channel time.

The arithmetic operation states ST1 to ST16 corresponding to the timing of generating the arithmetic operation state signals SY1 to SY16 which correspond to the arithmetic operation contents are shown in the following Table 1. Thus, in this embodiment, the arithmetic operation states ST1 to ST3 among 16 arithmetic operation states form a buzz wave and during the remaining arithmetic operation states ST4 to ST16, the modifying component Ai·Sin (Hi·$\omega$t) of a desired order is subtracted on a time division basis. In Table 1, I1 to I16 show the results of the operations of respective arithmetic operation states.

TABLE 1

| arithmetic operation state signal | arithmetic operation state | content of arithmetic operation | remark |
|---|---|---|---|
| SY1 | ST1 | $\sin\frac{n}{2} \cdot \omega t = I1$ | forms a buzz wave |
| SY2 | ST2 | $I1 \cdot \sin\left\{\frac{(n+1)}{2} \cdot \omega t\right\} = I2$ | |
| SY3 | ST3 | $A_0 \frac{I2}{\sin\frac{1}{2} \cdot \omega t} = I3$ | |
| SY4 | ST4 | $I3 - Ai \cdot \sin(Hi \cdot \omega t) = I4$ | Subtraction of modifying component |
| . | . | . | |
| . | . | . | |
| . | . | . | |
| SY16 | ST16 | $I15 - Ai \cdot \sin Hi \cdot \omega t = I16 = G$ | |

Turning back again to FIG. 2, although the detail is not shown, the key assigner 13 detects the ON.OFF operations of the key switches corresponding to respective keys of the key switch circuit, and assigns a key information representing a depressed key to either one of 16 tone generating channels, thereby producing key information KD assigned to respective channels on a time division basis and in synchronism with respective channel times. At this time, each channel time is sequentially divided by an arithmetic operation cycle signal Ø1 and one channel time is equal to the period of the signal Ø1. The key assigner 13 produces only one attack pulse AP showing that the generation of a musical tone is to be commenced in a tone generating channel assigned to a depressed key in synchronism with the channel time and thereafter supplied with a decay completion signal DF from a time-variant address generator 160, to be described later, showing that the tone generation of a given tone generating channel has been completed (completion of decay). In response to the decay completion signal DF, the key assigner 13 clears various memories regarding the tone generating channel waiting for depression of a new key.

The tone color selector 14 is provided with a plurality of tone color selection switches and an encoder which produces a tone color selection signal TS corresponding to a tone color selected by the tone color selection switch. Assuming that 8 tone color selection switches corresponding to tone colors of 1 to 8 are provided, the tone color selection signal TS is made up of 3 bits, a suitable combination of 3 bits representing respective tone colors 1 to 8.

Figure 5:
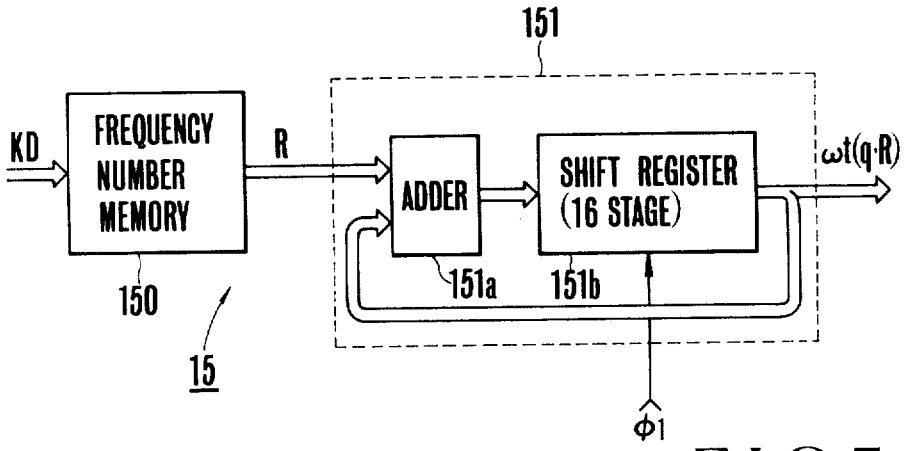
FIG. 5 is a block diagram showing the detail of the angular frequency information generator shown in FIG. 2.
Figure 6:
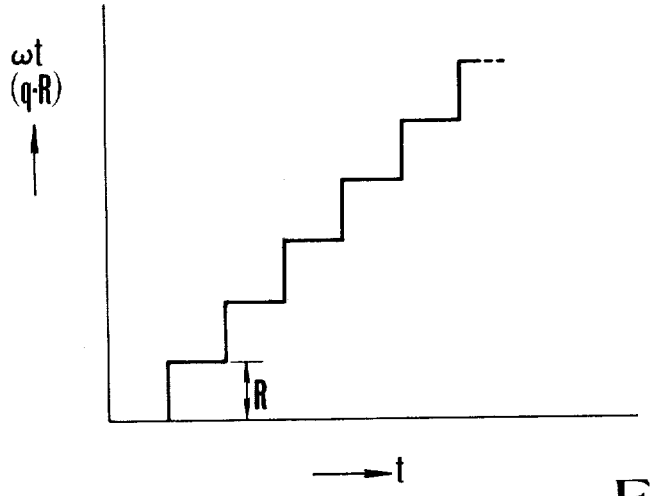
FIG. 6 is a graph useful to explain the operation of the output of the angular frequency information generator.

The angular frequency information generator 15 produces, on a time division basis, angular frequency informations $\omega t$ corresponding to the tone pitches of respective depressed keys in accordance with respective key informations of respective tone generating channels which are produced by the key assigner 13 on a time division basis. The details of the angular frequency information generator 15 are shown in FIG. 5. As shown, it comprises a frequency number memory device 150 which stores frequency numbers R corresponding to the tone pitches of respective keys in respective addresses and is addressed by a key information KD for producing a frequency number R corresponding to a key information KD; and an accumulator 151 comprising an adder 151*a* and a shift register 151*b*. The adder 151*a* adds together a frequency number R produced by the frequency number memory device 150 in each tone generating channel and an accumulated value q·R (q:1, 2, 3 . . . ) of the frequency number R of a given channel produced by the last (or 16th) stage of the shift register 151*b* having 16 stages corresponding to the number (16) of the tone generating channels, and sets the accumulated value in the first stage of the shift register 151*b* as a new accumulated value q·R of the given tone generating channel. The accumulated value q·R thus set is successively shifted each time an arithmetic operation cycle signal Ø1 (SY16) is generated. After completion of one cycle of 16 operations, the accumulated value q·R is produced from the last stage of the shift register in the given channel time, thereby forming a new accumulated value q·R. Consequently, the accumulated value q·R of one tone generating channel produced by the shift register 151*b* varies stepwisely with time as shown in FIG. 6, and the variation in the accumulated value q·R increases with the increase in the frequency number R and vice versa. Consequently, when a frequency number R is set to correspond to the tone pitch of a depressed key, the accumulated value q·R produced by the accumulator 151 is an angular frequency information $\omega t$ corresponding to the tone pitch of a depressed key. This angular frequency information $\omega t$ is used to form a musical tone signal G in an arithmetic operation circuit 16 to be described later in detail for each tone generating channel.

Figure 7:
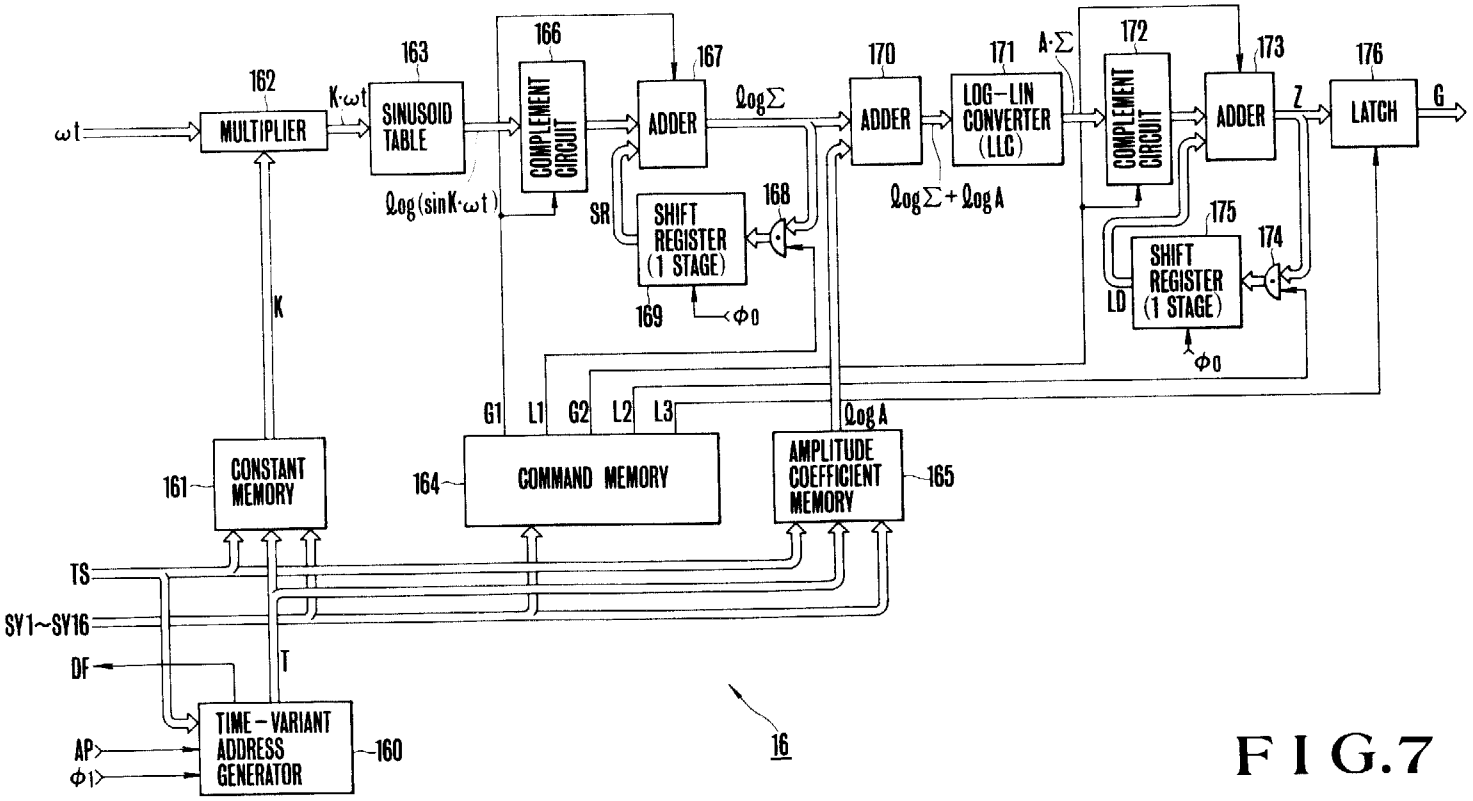
FIG. 7 is a block diagram showing the detail of the arithmetic operation circuit shown in FIG. 2.

The arithmetic operation circuit 16 operates to form, on a time division basis, musical tone signals G for respective tone generating channel according to equation (14) As shown in FIG. 7, arithmetic operation circuit 16 comprises time-variant address generator or time function generator 160 which produces a time function information T designated by a tone color selection signal TS for a tone generating channel in which the key assignor 13 has produced an attack pulse AP as well as a decay termination signal DF regarding the channel; and a constant memory device 161 which produces constants (n/2), (n+1/2), (1/2) and Hi as a constant K at a predetermined arithmetical operation state, the constant being used to form a buzz wave and a modifying component corresponding to the tone color selection signal TS and the time function information T. The constant memory device 161 is provided with 8 memory blocks corresponding to tone colors 1 to 8, and each of the memory blocks is provided with a plurality of sub-memory blocks corresponding to the contents of respective time function or time-variant address informations T. Each sub-memory block has 16 memory addresses corresponding to the arithmetic operation state signals SY1 to SY16 and in respective memory addresses are stored constants K as shown in the following Table 2. When a tone color selection signal TS, a time-variant address information T and one of arithmetic operation state signals SY1 to SY16 are applied as an address signal, the constants K stored in respective memory addresses of the sub-memory blocks of the memory block corresponding to the time-variant address information T are sequentially read out corresponding to respective arithmetic operation state signals SY1 to SY16.

TABLE 2

| arithmetic operation state signal | memory address | constant K |
|---|---|---|
| SY1 | 1 | K1 = n/2 |
| SY2 | 2 | K2 = n+½ |
| SY3 | 3 | K3 = ½ |
| SY4 | 4 | K4 = Hi |
| SY5 | 5 | K5 = Hi |
| SY6 | 6 | K6 = Hi |
| SY7 | 7 | K7 = Hi |
| SY8 | 8 | K8 = Hi |
| SY9 | 9 | K9 = Hi |
| SY10 | 10 | K10 = Hi |
| SY11 | 11 | K11 = Hi |
| SY12 | 12 | K12 = Hi |
| SY13 | 13 | K13 = Hi |
| SY14 | 14 | K14 = Hi |
| SY15 | 15 | K15 = Hi |
| SY16 | 16 | K16 = Hi |

The arithmetic operation circuit 16 further comprises a multiplier 162 which multiplies an angular frequency information $\omega t$ of each tone generating channel produced by the AFG 15 on a time division basis with a constant K produced by the constant memory device 161 at each arithmetic operation state time; a sinusoid table 163 which produces a logarithmic sine function value log (sin K·$\omega$t) corresponding to the product K·$\omega$t of the multiplier and digitally stores logarithmic sine function value log (sin K·$\omega$t) in each address. The sinusoid table 163 is addressed by a product K·$\omega$t of the multiplier 162 to read out the sine function value log (sin K·$\omega$t) corresponding to the product K·$\omega$t. The reason that the sine function value is converted into a logarithmic value lies in that the operation of a term $$\frac{\sin\frac{n\cdot\omega t}{2}\cdot\sin\frac{(n+1)\omega t}{2}}{\sin\frac{\omega t}{2}}$$

necessary to form a buzz wave is processed by addition and subtraction operations, thereby increasing the speed of calculation.

Figure 8:
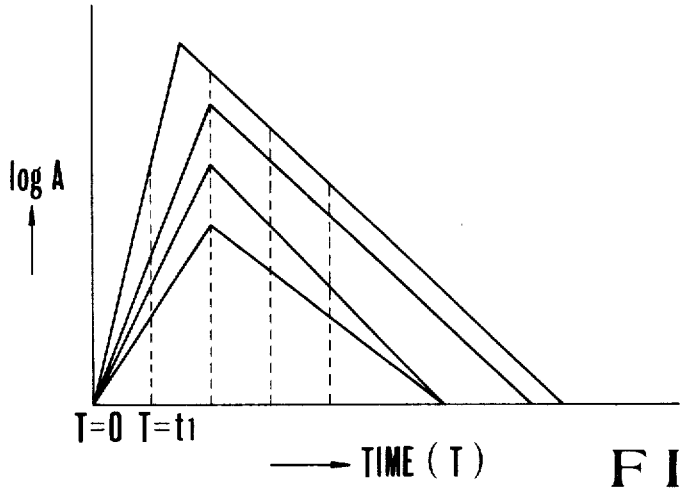
FIG. 8 is a graph for explaining the content of the amplitude coefficient memory device shown in FIG. 7.

A command memory device 164 is provided for applying control command signal to complement circuits 166 and 172, adder 167 and 173, a latch circuit 176 and AND gate circuits 168 and 174 (all to be described later) in one arithmetic operation cycle. The command memory device 164 is provided with 16 memory addresses in which are stored control command signals G1, L1, G2, L2 and L3 shown in the following Table 3. When arithmetic operation state signals SY1 to SY16 are applied as address signals, the control command signals G1, L1, G2, L2 and L3, which have been stored in the memory addresses corresponding to the state signals SY1 to SY16, are read out. There is also provided an amplitude coefficient memory device 165 which produces an amplitude coefficient log A (log A0, log Ai) for the buzz wave and the modifying component. Like the constant memory device 161 described above, the amplitude coefficient memory device 165 also comprises 8 memory blocks corresponding to the tone color selection signals TS, and each memory block stores one pair of amplitude coefficients log A regarding 8 types of percussive envelopes corresponding to 8 types of the tone colors. For the sake of brevity, only 4 types are shown in FIG. 8. Each memory block comprises a plurality of sub-memory blocks corresponding to the contents of the time function informations T, each sub-memory block storing 16 coefficient values log A1 (tn) to log A10 (tn), shown in Table 4, at respective times tn of the percussive envelope. Accordingly, when a tone color selection signal TS, a time-variant address information T and one of the arithmetic operation state signals SY1 to SY16 are applied as an address signal, one of the sub-memory block of a memory block corresponding to the tone color-selection signal TS is designated at a time represented by the value of the time-variant address information T so as to sequentially read out 16 coefficient values log A1 (tn) to log A16 (tn) which have been stored in the designated sub-memory block at each arithmetic operation state.

TABLE 3

| arithmetic state signal | memory address | control command signal | | | | |
|---|---|---|---|---|---|---|
| | | G1 | L1 | G2 | L2 | L3 |
| SY1 | 1 | 0 | 1 | 0 | 0 | 0 |
| SY2 | 2 | 0 | 1 | 0 | 0 | 0 |
| SY3 | 3 | 1 | 0 | 0 | 1 | 0 |
| SY4 | 4 | 0 | 0 | 1 | 1 | 0 |
| SY5 | 5 | 0 | 0 | 1 | 1 | 0 |
| SY6 | 6 | 0 | 0 | 1 | 1 | 0 |
| SY7 | 7 | 0 | 0 | 1 | 1 | 0 |
| SY8 | 8 | 0 | 0 | 1 | 1 | 0 |
| SY9 | 9 | 0 | 0 | 1 | 1 | 0 |
| SY10 | 10 | 0 | 0 | 1 | 1 | 0 |
| SY11 | 11 | 0 | 0 | 1 | 1 | 0 |
| SY12 | 12 | 0 | 0 | 1 | 1 | 0 |
| SY13 | 13 | 0 | 0 | 1 | 1 | 0 |
| SY14 | 14 | 0 | 0 | 1 | 1 | 0 |
| SY15 | 15 | 0 | 0 | 1 | 1 | 0 |
| SY16 | 16 | 0 | 0 | 1 | 0 | 1 |

TABLE 4

| arithmetic state signal | memory address | amplitude coefficient A |
|---|---|---|
| SY1 | 1 | log A1 (tn) = — |
| SY2 | 2 | log A2 (tn) = — |
| SY3 | 3 | log A3 (tn) = log A0 (tn) |
| SY4 | 4 | log A4 (tn) = log Ai (tn) |
| SY5 | 5 | log A5 (tn) = log Ai (tn) |
| . | . | . |
| . | . | . |
| . | . | . |
| . | . | . |
| SY15 | 15 | log A15 (tn) = log Ai (tn) |
| SY16 | 16 | log A16 (tn) = log Ai (tn) |

There are also provided complement circuit 166 which applies a complement to the sine function value log (sin K·ωt) of each tone generating channel produced from the sinusoid table 163 on a time division basis when the control command signal G1 is "1" and does not apply a complement when the control command signal G1 is "0"; and adder 167 which adds the output SR of the shift register 169 to the output of the complement circuit 166. The adder 167 cooperates with the complement circuit 166 to perform a subtraction operation when the control command signal G1 is "1" and an addition operation when the signal G1 is "0". More particularly, when the control command signal G1 is "0", (arithmetic operation states ST1 to ST2, ST4 to ST16, see Table 3) the sine function value log (sin K·ωt) would be directly applied to adder 167 without being complemented. When the control signal G1 is "1" (arithmetic operation state ST), the sine function value log (sin K·ωt) would be applied to the adder 167 after being complemented. Since the control command signal G1 at a level "1" is also applied to the carry input of the adder 167, a subtraction operation of the output SR of the shift register 169 and the sine function value log (sin K·ωt) would be performed. There are also provided AND gate circuit 168 which is enabled to pass the sum log Σ of the adder 167 to the shift register 169 when the control command signal is "1" (arithmetic operation states ST1 to ST2, see Table 3); shift register 169 which temporarily stores the sum log Σ of the adder 167 applied through the AND gate circuit 168 at each generation of the clock pulse φ0; and adder 170 which adds together the sum log Σ produced by adder 167 at each arithmetic operation state and the amplitude coefficient log A (log A1, log A2 . . .) produced by the amplitude information memory device 165; a logarithm-linear converter (LLC) 171 which converts the sum (log Σ+log A) produced by the adder 170 into a corresponding linear information A ·Σ; complement circuit 172 which applied a complement to the linear information A produced by the LLC 171 when the control command signal G2 is "1" (arithmetic operation states ST4 to ST16, see Table 3) and does not apply any complement to the linear information A·Σ (arithmetic operation states ST1 to ST3) when G2 is "0"; and adder 173 which adds the output of the complement circuit 172 to the output LD of the shift register 175. The adder 173 cooperates with the complement circuit 172 to perform an addition operation when the control command signal G2 is "0" whereas a subtraction operation when the signal G2 is "1".

There are also provided another complement circuit 172 which complements a linear information A·Σ produced by LLC 171 when the control command signal G2 is "1" (arithmetic operation states ST4 to ST16, see Table 3) and does not complement when the control command signal G2 is "0" (arithmetic operation states ST1 to ST3); and adder 173 which adds together the output of the complement circuit 172 and the output LD of the shift register 175. The adder 173 performs an addition operation in cooperation with the complement circuit 172 when the control command signal G2 is "0" whereas performs a subtraction operation when the signal G2 is "1". More particularly, when the control command signal G2 is "0" (arithmetic operation states ST1 to ST3), the linear information A·Σ would be directly applied to the adder 173 without being complemented, and then added to the output of the shift register 175, whereas when the control command signal G2 is "1" (arithmetic operation states ST4 to ST16) the linear information A·Σ is applied to the adder 173 after being complemented. Furthermore, as the control command signal G2 at a state "1" is also applied to the carry input of the adder 173, a subtraction operation between output LD of the shift register 175 and the linear information A·Σ would be performed. There are also provided AND gate circuit 174 which passes the sum X of the adder 173 to a shift register 175 (to be described hereunder) when the control command signal L2 is "1" (arithmetic operation states ST3 to ST15, see Table 3); the shift register 175 which is set with the sum Z of the adder 173 supplied through the AND gate circuit 174 for temporarily storing the sum; and latch circuit 176 which latches the sum Z produced by the adder 173 when the control command signal L3 is "1" (arithmetic operation state ST16, see Table 3) and produces a musical tone signal G for each tone generating channel.

Figure 9:
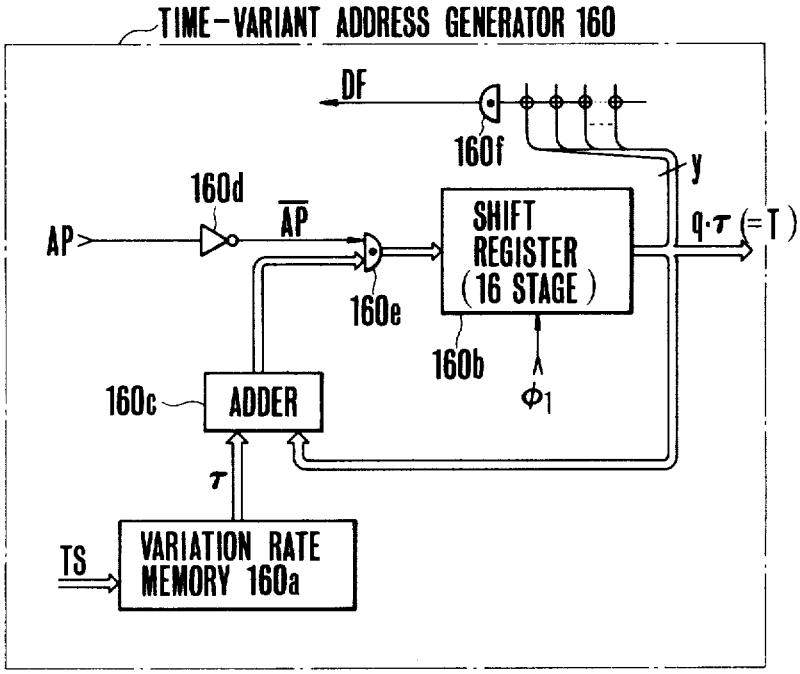
FIG. 9 is a block diagram showing the detail of the time variant address generator or time function generator.

The detail of the time-variant address generator 160 is shown in FIG. 9. It is provided for the purpose of sequentially generating the constant K described above, and the amplitude coefficient log A with elapse of time after depression of a key, and is constructed to sequentially accumulate, with the period of the calculation cycle signal $\phi 1$, the time information $\tau$ readout from the variation rate memory device 160a when it is addressed by a color setting signal TS, so as to produce the accumulated value q $\tau$(q:1, 2, 3 . . .) as a time function information T, thus producing a decay termination signal DF when the accumulated value reaches a predetermined value. More particularly, the time-variant address generator 160 is constituted by an adder 160c which adds the variation rate information $\tau$ to the accumulated value q $\tau$ of the variation rate information in each tone generating channel and produced, on the time division basis, from the last or 16th stage of a y bit/16 stage shift register 160b in synchronism with each channel time; an AND gate circuit 160e which passes the output of the adder 160c to a shift register 160b only when an attack pulse AP produced by an inverter 160d is "1", and an AND gate circuit 160f which produces a decay termination signal DF when all bits of the accumulated value q $\tau$ produced by the last stage of the shift register 160b become "1". When an attack pulse AP is applied from the key assigner 13 (see FIG. 2) during a channel time, (AP="1"), the accumulated value q $\tau$ corresponding to the tone generating channel is cleared. Thereafter, an accumulated value q $\tau$ regarding the tone generating channel is formed at a period of 16 times of that of the operation cycle signal $\phi 1$. Thus, when an attack pulse AP (AP="1") is applied during a given channel time an attack pulse AP (="0") obtained by inverting the attack pulse AP is applied to one input of the AND gate circuit 160e so that it is disabled during the channel time. For this reason, the content of the input stage of the shift register 160b becomes [0]. This content of the input stage is sequentially shifted at each operation cycle signal $\phi 1$ and is provided as an accumulated value [0] during the channel time after 16 cycles of the arithmetic operations. At this time, since the attack pulse AP is reset to "0", the AND gate circuit 160e is enabled. Accordingly, the sum (q $\tau+\tau$) corresponding to the sum of the accumulated value [0] and the variation rate information $\tau$ calculated by adder 160c is applied to the input stage of the shift register 160b as a new accumulated value. Thereafter, an accumulated value q $\tau$ regarding the tone generating channel would be formed in the same manner. Since the shift register 160b has a capacity of 16 stages corresponding to the number of the tone generating channels, the accumulated values for respective tone generating channels are formed independently, whereby the time-variant address information T for each tone generating channel would be produced on a time division basis in synchronism with each channel time.

Figure 10:
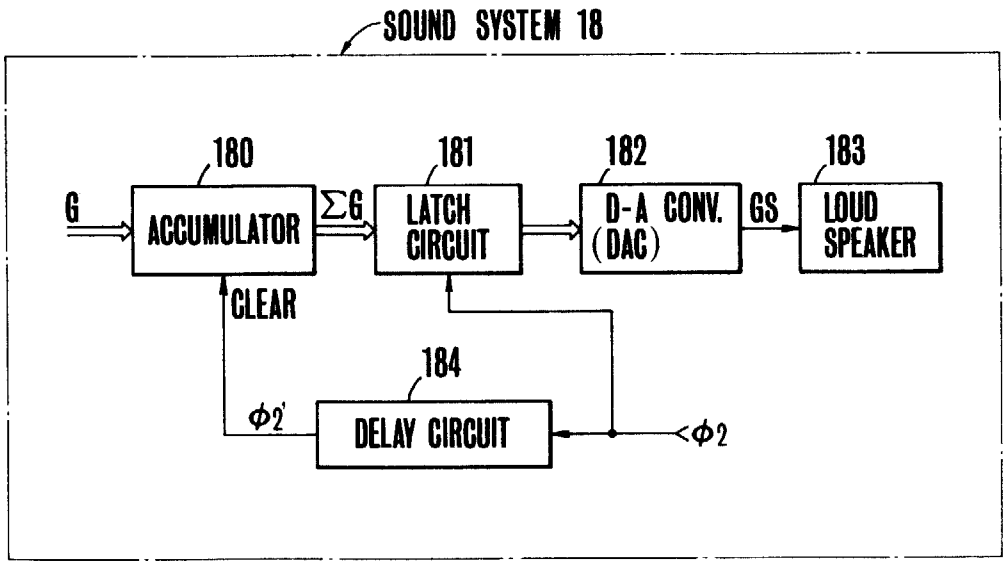
FIG. 10 is a block diagram showing the detail of the sound system shown in FIG. 2.

As shown in detail in FIG. 10, the sound system 18 comprises an accumulator 180 for accumulating the musical tone signal G of each tone generating channel over 16 channel times (during which all tone generating channels complete one cycle); a latch circuit 181 which latches the accumulated value ΣG produced by the accumulator 180 at a timing of the channel synchronizing signal $\phi 2$; a digital-analogue converter 182 which converts the output ΣG of the latch circuit 181 into a corresponding analogue musical tone signal GS; and a loudspeaker 183 which converts the musical tone signal GS into a musical tone. The accumulated value ΣG of the accumulator 180 is cleared by a channel synchronizing signal $\phi 2'$ which is delayed a little by a delay circuit 184, the delay time thereof being set to be much shorter than the pulse width of the operation cycle signal $\phi 1$.

Figure 4:
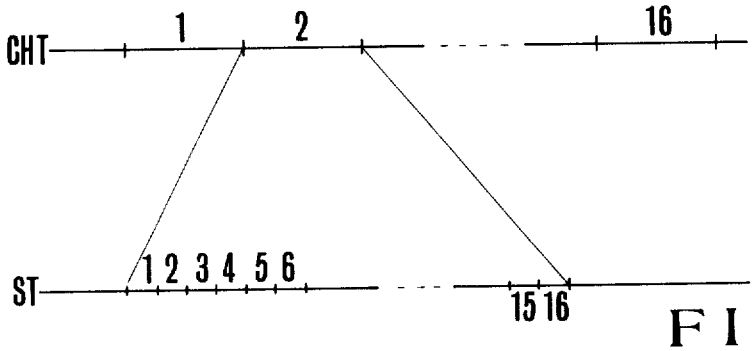
FIG. 4 is a graph showing the relationship between the channel time and the arithmetic operation state in the timing pulse generator shown in FIG. 3.

The electronic musical instrument described above operates as follows. After connecting it to a source of supply, TPG 11 constantly produces a clock pulse $\phi 0$ having a predetermined period, arithmetic operation state signals SY1 to SY16 ($\phi 1$) having a time relationship as shown in FIG. 4, and a channel synchronizing signal $\phi 2$. After selecting a desired tone color with the tone color selector 14, when certain numbers of keys of the keyboard are depressed, the key assigner 13 sequentially assigns the key informations corresponding to the depressed keys to 16 tone generating channels thereby producing key informations KD attack pulses AP on a time division bases and in synchronism with the channel times corresponding to the assigned channels. The key informations KD produced by the key assigner 13 are applied to APG 15 to produce, on a time division basis, angular frequency informations ωt corresponding to the tone pitches of the depressed keys. The angular frequency informations ωt are applied to the arithmetic operation circuit 16 to produce musical tone signals G corresponding to the tone pitches of the depressed keys during respective channel times. In the following, the operation of the arithmetic operation circuit 16 will be described for each arithmetic operation state during one channel time.

Arithmetic Operation State ST1

A constant K(K1) produced from the constant memory device 161 by the arithmetic operation state signal SY1 corresponding to the tone color selection signal TS and the time-variant address information T, that is a constant n/2 (see Table 2) is multiplied with the angular frequency information ωt by the multiplier 162. The product n/2·ωt is applied to the sinusoid table 163 to act as an address signal to read out therefrom a sine function value log sin n/2·ωt corresponding to the product n/2·ωt. On the other hand, at this arithmetic operation state ST1, the command memory device 164 produces control command signals G1="0", L1="1", G2="0", L2="0" and L3="0" (see Table 3) corresponding to the arithmetic operation state signal SY1. Accordingly, the complement circuit 166 applies to the adder 167 the sine function value log sin n/2·ωt read out from the sinusoid table 163 without applying any complement. At this time, the output SR of the shift register 169 is [0]. In other words, after the arithmetic operation state ST3 in the preceding operation cycle, since the control command signal L1 becomes "0" [0] is set in the shift register 169 at the arithmetic operation state and thereafter its output SR is maintained at [0]. For this reason, the sum log Σ produced by adder 167 at the arithmetic operation state ST1 is:

$$\log \Sigma = \log \sin K \cdot \omega t + SR = \log \sin \frac{n}{2} \cdot \omega t + 0$$

$$= \log \sin \frac{n}{2} \cdot \omega t.$$

Since the control command signal L1 is "1" as shown in Table 3, the sum log Σ is set in the shift register 169 via the AND gate circuit 168. At the same time, this sum is also applied to adder 170 to be added to the amplitude coefficient log A produced by the amplitude coefficient memory device 165. However, since the amplitude coefficient memory device 165 does not produce any amplitude coefficient under this arithmetic operation state ST1 (see Table 4), the sum (log Σ+log A) of the adder 170 becomes log Σ, which is converted into a corresponding linear information Σ by LCC 171, and then applied to adder 173 without being complemented. At this time, the output LD of the shift register 175 applied to the other input of the adder 173 is [0]. In other words, since the control command signal L2 becomes "0", at the arithmetic operation state during the previous calculation cycle, [0] would be set in the shift register 175 at the arithmetic operation state ST16 whereby its output LD becomes [0] at the arithmetic operation state ST1 of the new operation state. Accordingly, the sum Σ produced by the adder 173 becomes Σ which is supplied to the latch circuit 176. However, since the control command signal L3="1" is applied to the latch circuit 176 only at the arithmetic operation state ST16, the sum Σ(=Σ) would not be latched by the latch circuit 176. Thus, the latch circuit 176 continues to hold the musical tone signal G in the previous operation cycle. Accordingly, only the sum log Σ(=log sin n/2·ωt) set in the register 169 is effective under this state St1.

Arithmetic Operation State ST2

During this state ST2, the constant K2 read out from the constant memory device 161 by the arithmetic operation state signal SY2 becomes n+1/2 (see Table 2). As a consequence, the multiplier 162 multiplies the angular frequency information ωt with the constant n+1/2 to apply the product n+1/2·ωt to the sinusoid table 163 to act as an address signal. Thus, a sine function value log sin n+1/2·ωt corresponding to the product n+1/2·ωt is read out from the sinusoid table 163. On the other hand, under arithmetic operation state ST2, the command memory device 164 produces control command signals G1="0", L1="1", G2="0", L2="0" and L3="0" (see Table 3) corresponding to the arithmetic operation state signal SY2. Accordingly, the complement circuit 166 directly applies the sine function value log sin n+1/2·ωt read out from the sinusoid table 163 without adding any complement. At this time, the output SR of the shift register 169 corresponds to log sin n/2·ωt which was set therein at the state ST1. Accordingly, the sum log Σ produced by the adder 167 is expressed by the following equation $$\log \Sigma = \log \sin n/2 \cdot \omega t + \log \sin n + 1/2 \cdot \omega t.$$

At this time, since the control command signal L1="1", this sum log Σ is set in the shift register 169 via the AND gate circuit 168. At the same time, the sum is also applied to adder 170 to be added to the amplitude coefficient log A produced by the amplitude coefficient memory device 165. However, since the amplitude coefficient memory device 165 does not produce any amplitude coefficient under this state ST2 (see Table 4) the sum (log Σ+log A) of the adder 170 becomes log Σ, which is applied to the latch circuit 176 via LLC 171, complement circuit 172 and adder 173 in the same manner as in the arithmetic operation state ST1. However, as the control command signal L3="0", this sum would not be latched by the latch circuit 176, so that this circuit continues to maintain the musical tone signal G in the previous operation cycle. Although the output Σ of the adder 173 is also applied to AND gate circuit 174, since under state ST2, the control command signal L2 is "0", the sum Z would not be set in the shift register 175, and its output LD is maintained at [0]. Thus under this state, only the sum log Σ set in the shift register 169, that is log sin n/2·ωt+log sin n+1/2·ωt (=log sin n/2·ωt sin n+1/2·ωt) is effective under the state ST2.

Arithmetic Operation State ST3

Under this state, the constant K (K3) read out from the constant memory device 161 by the arithmetic operation state signal SY3 becomes ½ (see Table 2). Thus, the multiplier 162 multiplies the angular frequency information ωt with a constant ½ to apply its product ½·ωt to the sinusoid table 163 as an address signal, thus reading out therefrom a sine function value log sin ½·ωt corresponding to the product ½·ωt. Under this state ST3, the command memory device 164 produces control command signals G1="1", L1="0", G2="0", L2="1" and L3="0" corresponding to the arithmetic operation state signal SY3 (see Table 3). Thus, the complement circuit 166 applies a complement to the sine function value log sin ½·ωt read out from the sinusoid table 163 and then applies it to the adder 167. At this time, a control command signal G1="1" is also applied to the carry input of the adder 162. Thus, the adder 167 subtracts the sine function value log sin ½·ωt from the output SR of the shift register 169. In other words, the following operation is performed by adder 167 in state ST3

$$\log \Sigma = SR - \log \sin \tfrac{1}{2} \cdot \omega t$$

$$= \left( \log \sin \frac{n}{2} \cdot \omega t + \log \sin \frac{n+1}{2} \cdot \omega t \right) - \log \sin \tfrac{1}{2} \cdot \omega t$$

$$= \log \frac{\sin \left( \frac{n}{2} \cdot \omega t \right) \cdot \sin \left( \frac{n+1}{2} \cdot \omega t \right)}{\sin \frac{n}{2} \cdot \omega t}$$

This sum log Σ is applied to adder 170 and AND gate circuit 168. In the adder 170 the sum is added to the amplitude coefficient A0 of the buzz wave produced by the amplitude coefficient memory device 165. However, since the control command signal L1="0", the sum log Σ can not pass through the AND gate circuit 168 so that it will not be set in the shift register 169. The sum (log Σ+log A0) of the adder 170, that is the buzz wave, is converted by LCC 171 into a corresponding linear information A·Σ (=A0·Σ) which is applied to the complement circuit 172. At this time, since control command signal G2="0", the complement circuit 172 applies the linear information A·Σ corresponding to the buzz wave directly to the adder 173 without applying any complement. At this time, since the output LD of the shift register 175 is (0), the sum Z produced by the adder 173 is equal to A0·Σ which represents the buzz wave itself. At this arithmetic operation state ST3, since the control command signal L2="1", it passes through the AND gate circuit 174 and is then set in the shift register 175. At the same time, although the sum Z=A-0·Σ is also applied to the latch circuit 176, since the control command signal L3="0", this sum would not be latched by the latch circuit. Consequently, at this state ST3 the fact that the sum Z expressed by $$Z0 = 0\frac{\sin\left(\frac{n}{2}\cdot\omega t\right)\cdot\sin\left(\frac{n+1}{2}\cdot\omega t\right)}{\sin\frac{1}{2}\cdot\omega t}$$

and set in the register 175 forms the buzz wave. More particularly, at states ST1 to ST3, during one operation cycle a buzz wave made up of n harmonic components corresponding to the color selection signal TS and the time-variant address information T is formed.

Arithmetic Operation State ST4

At this state, the constant K (K4) read out from the constant memoery device 161 by the arithmetic operation state signal SY4 is a constant Hi showing a harmonic order necessary to form a desired modifying component. Thus, the multiplier 162 multiplies the angular frequency information ωt with the constant Hi to apply the product Hi·ωt to the sinusoid table 163 as an address signal. Accordingly, a sine function value log sin Hi·ωt corresponding to the product Hi·ωt is read out from the sinusoid table 163. At this state ST4, the command memory device 164 produces control command signals G1="0", L1="0", G2="1", L2="1" and L3="0" (see Table 3) corresponding to the arithmetic operation state signal SY4. Consequently, the complement circuit 166 supplies the sine function value log sin Hi·ωt read out from the sinusoid table 163 directly to the adder 167 without adding any complement. At this time, the output SR of the shift register 169 has been made to "0" in the previous state ST3 so that the output log Σ of the adder 167 is expressed by $$\log\Sigma = \log\sin Hi\cdot\omega t.$$

This output is applied to both AND gate circuit 168 and adder 170. During the states ST4 to ST16 since the AND gate circuit 168 is disabled by the control command signal L1, the output log Σ of the order would not be set in the shift register 169. In adder 170, the sum log Σ is added to the amplitude coefficient Ai for the modifying component of the order Hi read out from the amplitude coefficient memory device 165 at state ST4 and the sum (log Σ+log A) thus obtained represents the modifying component of order Hi expressed by the following equation $$\log\Sigma + \log\ = \log\sin Hi\cdot\omega t + \log i$$

-continued $$= \log i\cdot\sin Hi\cdot\omega t$$

The sum log Σ+log A representing the modifying component of an order shown by Hi is converted into a corresponding linear information, i.e. Ai sin Hi·ωt by LLC 171 and then applied to the complement circuit 172. At this time, since the control command signal G2="1", the complement circuit 172 applies a complement to the linear information Ai sin Hi·ωt and then applies the complemented information to adder 173. At the same time, a control command signal G2="1" is applied to the carry input of the adder 173. Consequently, the adder 173 subtracts the linear information A·Σ from the output LD of the shift register 175. In other words, the adder 173 performs the following operation at state ST4.

$$Z = LD - i\cdot\sin\omega t\, Hi\cdot\omega t$$

$$= \frac{\sin\left(\frac{n}{2}\cdot\omega t\right)\cdot\sin\left(\frac{n+1}{2}\cdot\omega t\right)}{\sin\frac{1}{2}\cdot\omega t} - i\cdot\sin Hi\cdot\omega t$$

Thus, the modifying component of the order shown by Hi is subtracted from the buzz wave formed during the arithmetic operation states ST1 to ST3. Since at this time the control command signal L2="1", the result of subtraction operation Z is set in the shift register 175 via AND gate circuit 174. Although this result of subtraction Z is also applied to the latch circuit 176, it would not be latched thereby because the control command signal L3="0", so that the latch circuit preserves the musical tone signal in the previous operation cycle. Thus, at this state ST4, the difference between the buzz wave and the modifying component of an order shown by Hi is temporarily stored in the shift register 175.

Arithmetic Operation States ST5 to ST16

The operations at these states are similar to that of state ST4. Thus, the constants K (K5 to K16) read out from the constant memory device 161 at respective states, that is a constant Hi representing the order of a desired modifying component is multiplied with an angular frequency information ωt in multiplier 162 and the resulting product Hi·ωt is used to address the sinusoid table 163 for reading out a sine function value log sin Hi·ωt which is directly applied to adder 167 without being complemented by the complement circuit 166 because the control command signals G1="0", L1="0", G2="1" and L3="0" during the states ST4 to ST15. Since the output SR of the shift register 169 is (0) during the states ST3 to ST16, the sum log Σ of the adder 167 is equal to the sine function value log sin Hi·ωt read out from the sinusoid table 163 at each state. The sum log Σ produced by adder 167, i.e. the sine function value log sin Hi·ωt is added to the amplitude coefficient log Ai at each state by adder 170 to produce a sum:

$$\log\Sigma + \log\ = \log\sin Hi\cdot\omega t + \log i$$
$$= \log i\cdot\sin Hi\cdot\omega t$$

When this sum is converted into a linear information by LLC 171, it produces a linear information A·Σ

$$A\cdot\Sigma = Ai\cdot\sin Hi\cdot\omega t$$

Thus, a modifying component at each state is formed. At states ST4 to ST16, since the control command G2="1" the modifying component is complemented by the complement circuit 172 and then applied to adder 173 to be subtracted by the output LD of the shift register 175 in adder 173. In this manner, the modifying components at respective states are sequentially subtracted from the output LD of the shift register 175. The results of these subtraction operations are set in the shift register 175 up to state ST15, whereas at ST16 the result of subtraction would be latched by the latch circuit 176 because the control command signal L3="1". Thus, the results of operations of the arithmetic operation circuit 16 at the states ST4 to ST16 are shown by the following equation. More particularly, m modifying components of the orders shown by Hi are sequentially subtracted from the buzz wave calculated during the states ST1 to ST3.

$$G = 0 \cdot \frac{\sin\left(\frac{n}{2} \cdot \omega t\right) \cdot \sin\left(\frac{n+1}{2} \cdot \omega t\right)}{\sin \frac{1}{2} \cdot \omega t} - \sum_{i=1}^{m} i \cdot \sin Hi \cdot \omega t$$

In the above, the states that form the modifying components are 13 states of ST4 to ST16, but it is possible to designate modifying components of the orders of a maximum of 13 types. Thus, m in the above equation is 13 at the maximum in this embodiment.

Figure 11A:
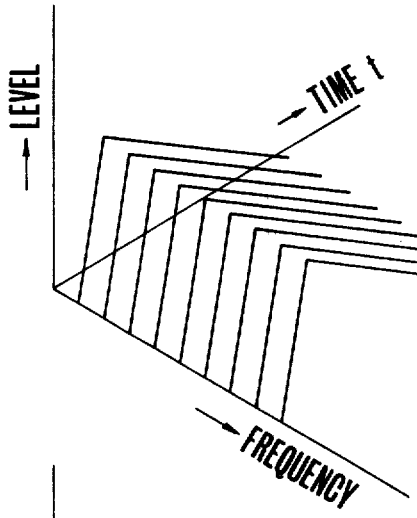
FIGS. 11A, 11B and 11C are graphs showing examples of a buzz wave, a modifying component relating to one tone generating channel provided for the electronic musical instrument, and a musical tone signal obtainable by combining the buzz wave and the modifying component.
Figure 11B:
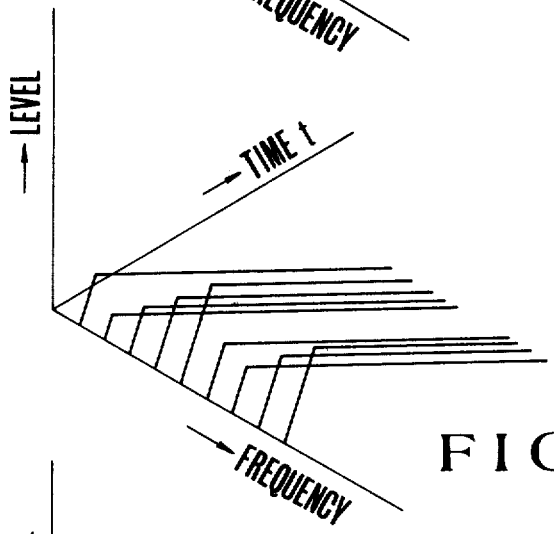
Figure 11C:
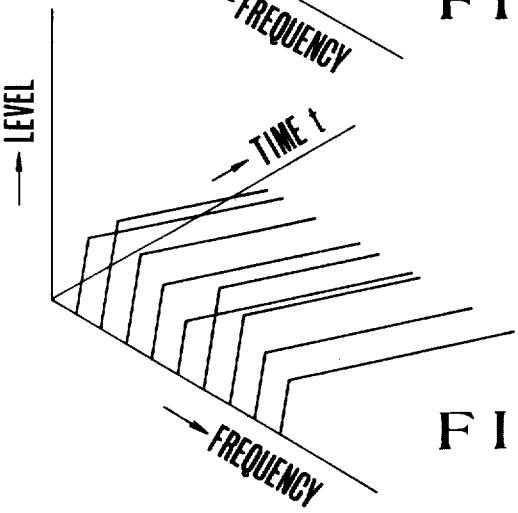

The musical tone signal G latched by the latch circuit 176 corresponds to the tone color selection signal TS and also to the instantaneous values of the angular frequency information ωt and the time-variant address information T. Since the number of the tone generating channels is 16, the operation cycle of the tone generating channel completes at a period of 16 times of that of the operation cycle signal $\phi 1$, during which musical tone signal G for each tone generating channel is formed on a time division basis. Consequently the angular frequency information ωt and the time-variant address information T regarding a given tone generating channel and produced by AFG 15 and the time-variant address generator 160 show new values after a period of $16\phi 1$. Based on these new time-variant address information T and the angular frequency information ωt, an arithmeric operation regarding the given tone generating channel is performed thereby forming a musical tone signal G at a new time. Thereafter, when the time-variant address information T reaches a predetermined maximum value in that channel, the time-variant address generator 160 produces a decay termination signal OF in synchronism with the channel time thus clearing various memories of key assigner 13 of that channel. Accordingly, by selecting the amplitude coefficient log A (log A0, log Ai) to correspond to a percussive tone as shown in FIG. 8, the pulse wave of that tone generation channel will be shown by FIG. 11A whereas the modifying component by FIG. 11B. Accordingly, the musical tone signal obtained by subtracting the modifying component from the buzz wave will be shown by FIG. 11C. Although the above description refers to only one tone generation channel, it should be understood that the musical tone signals G corresponding to depressed keys can be formed similarly for another channels.

The musical tone signals G of various tone generation channels are supplied to the sound system 18 and synthesized by the accumulator 180. The resultant ΣG is latched by the latch circuit 181 at the timing of generation of the channel synchronizing signal $\phi 2$ and then converted into a corresponding analogue musical tone signal GS by digital-analogue converter 182, with the result that the loudspeaker 183 produces a musical tone corresponding to the musical tone signals.

As above described, with the electronic musical instrument of this embodiment, in each channel time of 16 tone generation channels, a buzz wave comprising n harmonics is formed based on an angular frequency information ωt and a tone color selection signal corresponding to the tone pitches of the depressed key during arithmetic operation states ST1 to ST3, then during the states ST4 to ST16, m modifying components of the orders shown by Hi and imparted with a predetermined amplitude coefficient Ai sequentially subtracted, on a time division basis, from the buzz wave, the operations being repeated to form musical tone signals G having desired color tones. For this reason, even musical tone signals containing many amplitude components can be formed with lesser number of time slots. In other words, it is possible to form high speeds musical tone signals containing many harmonic components. Furthermore, since the harmonic components of the buzz wave desired to be suppressed are obtained by subtracting on the time division basis the modifying components, the amounts of suppression can be controlled independently. Such amounts of depression can be controlled as desired by varying the memory contents of the amplitude information memory device. Consequently, it is possible to produce any musical tone having a tone color and containing many harmonic components similar to those of the natural musical instruments.

Although in the foregoing embodiment the musical tone signal was formed according to equation (14), if it is desired to produce a musical tone signal by emphasizing certain harmonic components with respect to the buzz wave, a modifying component $$\sum_{i=1}^{m} i \cdot \sin Hi \cdot \omega t$$

may be added in equation (14) (see equation (6)). Furthermore, while the harmonic component of each order was formed from a sine function value sin·ωt corresponding to an angular frequency information ωt, a cosine function value cos·ωt can also be used. Thus, the musical tone signal can be formed according to equations (8) and (9). Where it is desired to produce a musical tone signal containing harmonic components containing only odd orders equations (10) and (11) are used, whereas it is desired to produce a musical tone signal containing harmonic components containing only even orders equations (12) and (13) may be used. A musical tone signal can be produced with equation (6) by making all control command signals G2 to be "0" which are produced from the command signal memory device 164 shown in FIG. 7 during states ST4 to ST16. To produce a musical signal with equations (8) and (9) a cosine function memory device may be added which produces a cosine function value cos K·ωt corresponding to a information K·ωt which is used as an address signal. The cosine function is then controlled by a new control signal produced by the command memory device 164.

Furthermore, in order to produce a musical signal with equations (10) through (13), the values of constants K stored in the constant memory device 161 are varied suitably. Where a musical signal is produced with equations (12) and (13), an additional device for producing the fundamental component of the musical tone signal is provided. The arithmetic operating circuit 16 may be substituted by a stored program type arithmetic operating device, or a microcomputer. With these computers it is possible to produce musical tone signals having any desired color tones.

Although in the foregoing embodiment, the amplitude envelope of the generated musical tone was made to correspond to a percussive tone, this envelope may be made to correspond to such envelopes of continuous modes as attack, sustain and decay which are produced by a conventional envelope waveform generator, by slightly modifying content of the amplitude information memory device and the construction of the time function generator.

As above described according to this invention a buzz wave comprising n harmonic components is generated, a harmonic component of a desired order and having a suitable amplitude is added to or subtracted from the buzz wave thus producing a desired musical tone. For this reason, even a musical tone containing many harmonic components can be computed at high speed and respective harmonic components can be controlled independently. Accordingly, it is possible to produce any musical tones like those of natural musical instruments.

It should be understood that the invention is not limited to the specific embodiment described above and that many changes and modifications will be obvious to one skilled in the art.

For example, in the calculation of equation (14) with reference to FIG. 7, instead of calculating, on a time division basis, the buzz component $$0 \cdot \frac{\sin \frac{n \cdot \omega t}{2} \cdot \sin \frac{(n+1)\omega t}{2}}{\sin \frac{\omega t}{2}}$$

and the modifying component $$\sum_{i=1}^{m} i \sin Hi$$

with a single common circuit, it is possible to independently calculate these terms at different circuits and then add the terms with an adder or subtractor to calculate equation (14). To this end the circuit shown in FIG. 7 should be modified slightly. For example, elements 172, 173, 175 and 176 are eliminated from the circuit shown in FIG. 7 provided for determining the buzz wave, and elements 160, 166, 167, 168, 169 and 176 are eliminated from the circuit for determining the modifying components. After being added together by an adder, these components are latched by a latch circuit which produces a musical tone signal. The same modification may be made in the calculation of equations other than equation (14).

What is claimed is:

1. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin \frac{n \cdot f(x)}{2} \cdot \sin \frac{(n+1) \cdot f(x)}{2}}{\sin \frac{f(x)}{2}}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

2. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin \frac{n \cdot f(x)}{2} \cdot \sin \frac{(n+1) \cdot f(x)}{2}}{\sin \frac{f(x)}{2}}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

3. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin \frac{n \cdot f(x)}{2} \cdot \cos \frac{(n+1) \cdot f(x)}{2}}{\sin \frac{f(x)}{2}}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

4. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin \frac{n \cdot f(x)}{2} \cdot \cos \frac{(n+1) \cdot f(x)}{2}}{\sin \frac{f(x)}{2}}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

5. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin^2 \{n \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

6. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin^2 \{n \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

7. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\cos\{n \cdot f(x)\} \cdot \sin\{n \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

8. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\cos\{n \cdot f(x)\} \cdot \sin\{n \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

9. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin\{n \cdot f(x)\} \cdot \sin\{(n+1) \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

10. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin\{n \cdot f(x)\} \cdot \sin\{(n+1) \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

11. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin\{n \cdot f(x)\} \cdot \cos\{(n+1) \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \sin Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

12. In an equipment for developing a waveshape and modifying the waveshape to produce a musical tone signal in a desired frequency range, the improvement of a system for generating a composite waveshape having n possible components of different frequency in the amplitude of any sample point of the waveshape, comprising:

first means for generating a function f(x) containing a time variable;

second means for generating a waveshape F(x) in accordance with the equation $$F(x) = \frac{\sin\{n \cdot f(x)\} \cdot \cos\{(n+1) \cdot f(x)\}}{\sin f(x)}$$

wherein n is an integer greater than one and represents the number of harmonic components constituting the waveshape F(x);

third means for modifying the harmonic components of said waveshape F(x) and for generating, by the use of said function f(x), a modifying signal in accordance with the expression $$\sum_{i=1}^{m} \cos Hi \cdot f(x)$$

wherein m satisfies the condition $1 \leqq m < n$ and Hi is the order of each harmonic component to be modified; and fourth means for modifying selected ones of the harmonic components of the waveshape F(x) in accordance with said modifying signal to produce a musical tone signal.

13. An electronic musical instrument according to claim 1 or claim 2 or claim 8 or claim 4 or claim 5 or claim 6 or claim 7 or claim 8 or claim 9 or claim 10 or claim 11 or claim 12 wherein said function f(x) comprises an angular frequency information wt corresponding to a tone pitch of a depressed key.

14. An electronic musical instrument according to claim 1 or claim 2 or claim 3 or claim 4 or claim 5 or claim 6 or claim 7 or claim 8 or claim 9 or claim 10 or claim 11 or claim 12 wherein said function f(x) comprises an angular frequency information 2 wt corresponding to a tone pitch of a depressed key.

15. An electronic musical instrument according to claim 13 wherein said function f(x) comprises an angular frequency information wt corresponding to a tone pitch of a depressed key in a plurality of keys and wherein said function generating means comprises a frequency under memory device which stores in addresses thereof frequency numbers corresponding to tone pitches of said keys and produces a frequency number corresponding to a tone pitch of the depressed key when addressed by a key information corresponding to a depressed key; and an accumulator which accumulates at a predetermined speed a frequency number read out from said frequency number memory device for producing an accumulated value as an angular frequency information wt.

16. An electronic musical instrument according to claim 14 wherein said function f(x) comprises an angular frequency information 2 wt corresponding to a tone pitch of a depressed key in a plurality of keys and wherein said function generating means comprises a frequency number memory device which stores in addresses thereof frequency numbers corresponding to tone pitches of said keys and produces a frequency number corresponding to a tone pitch of the depressed key when addressed by a key information corresponding to the depressed key; and an accumulator which accumulates at a predetermined speed a frequency number read out from said frequency number memory device for producing an accumulated value as an angular frequency information.

17. An electronic instrument for producing a musical tone signal, said instrument comprising means for producing a buzz wave signal constituted by a fundamental wave component and a plurality of harmonic components of different orders, all of said constituent components of said buzz wave signal having equal amplitudes to form a flat spectral distribution;

means for producing one or more modifying signals having frequencies equal to selected one or ones of said harmonic components;

means for modifying the level of various harmonic components contained in said buzz wave signal in accordance with said modifying signals, the amplitude of said selected ones of said harmonic components of said buzz wave signal modified by said modifying signals of frequencies equal to said selected ones of the harmonic components to generate a modified buzz wave signal characterized by a selected harmonic content; and means for receiving said modified buzz wave signal to produce a musical tone signal.

* * * * *